US009566532B1

(12) United States Patent
Walterscheid et al.

(10) Patent No.: US 9,566,532 B1
(45) Date of Patent: Feb. 14, 2017

(54) ROLLING TOY SKATEBOARD CHARACTER AND ITS METHOD OF CONSTRUCTION

(71) Applicant: FSD, LLC, Bend, OR (US)

(72) Inventors: Steven Edward Walterscheid, Bend, OR (US); Leopold Elias Walterscheid, Bend, OR (US)

(73) Assignee: FSD, LLC, Bend, OR (US)

( * ) Notice: Subject to any disclaimer, the term of this patent is extended or adjusted under 35 U.S.C. 154(b) by 0 days.

(21) Appl. No.: 15/140,455

(22) Filed: Apr. 27, 2016

(51) Int. Cl.
*A63H 7/00* (2006.01)
*A63H 17/00* (2006.01)

(52) U.S. Cl.
CPC ..... *A63H 17/00* (2013.01)

(58) Field of Classification Search
CPC ..... A63H 11/10; A63H 13/18; A63H 15/04
See application file for complete search history.

(56) References Cited

U.S. PATENT DOCUMENTS 742,250 A * 10/1903 Spencer ..... A63H 11/10 446/269
800,741 A * 10/1905 Howard ..... A63H 11/10 446/269
811,775 A * 2/1906 Keen et al. ..... A63H 29/08 446/169
3,665,642 A * 5/1972 Horner ..... A63H 13/04 446/325
4,151,676 A * 5/1979 Clark ..... A63H 15/02 446/325
4,605,224 A * 8/1986 Torii ..... A63B 21/0004 273/141 R
4,982,961 A * 1/1991 Ichimura ..... A63F 9/16 273/109
5,041,049 A * 8/1991 Wax ..... A63H 15/00 446/269
5,893,791 A * 4/1999 Wilkinson ..... A63H 33/005 446/269
6,071,173 A 6/2000 Kelley
6,679,750 B1 * 1/2004 Nielsen ..... A63H 7/00 446/278
7,258,591 B2 * 8/2007 Xu ..... A63H 33/26 446/273
7,300,392 B1 * 11/2007 Curran ..... A63B 21/0004 482/146
7,775,952 B1 * 8/2010 Curran ..... A63B 22/18 482/146

(Continued)

*Primary Examiner* — Aarti B Berdichevsky
*Assistant Examiner* — Urszula M Cegielnik
(74) *Attorney, Agent, or Firm* — LaMorte & Associates, P.C.

(57) ABSTRACT

A rolling toy assembly that has a hollow body. The hollow body has an interior and a bottom surface with an open window that accesses the interior. A spherical mass is disposed within the interior of the hollow body. The spherical mass is too large to pass completely through the open window. An eccentric weight is coupled to the hollow body. The eccentric weight biases the hollow body into a tilted position wherein the bottom surface and the window are tilted at an angle of inclination. This enables the toy assembly to roll over small obstacles. A play platform is provided. The play platform has a top surface that defines at least one concavity. The concavity is surrounded by a peripheral rim bump. The toy assembly is placed on the play platform and is caused to roll by manually manipulating the play platform.

12 Claims, 6 Drawing Sheets

(56) References Cited

U.S. PATENT DOCUMENTS

| | | | | |
|---|---|---|---|---|
| 8,517,791 | B2 * | 8/2013 | Yamada | A63H 33/003 446/129 |
| 2011/0104982 | A1 | 5/2011 | Koehl | |
| 2013/0053097 | A1 * | 2/2013 | Phillips | H04M 1/72527 455/556.1 |

* cited by examiner

ROLLING TOY SKATEBOARD CHARACTER AND ITS METHOD OF CONSTRUCTION

BACKGROUND OF THE INVENTION

1. Field of the Invention

In general, the present invention relates to rolling toy characters that appear to be skateboarding. More particularly, the present invention relates to rolling toys with a free-rolling internal mass that provides momentum to the toy as it rolls.

2. Prior Art Description

There are many toys that roll. These toys come in a wide variety of shapes and sizes, such as toy cars, toy trucks, and even toy characters that are mounted atop toy skateboards. Most toys that roll, roll on wheels. However, there is a subset of rolling toys that do not roll on wheels. Rather, some toys contain a single spherical mass that can be rolled with great momentum. The toy is designed around the spherical mass, wherein the toy is propelled by the momentum of the rolling spherical mass within the toy. Such prior art rolling toys are exemplified by U.S. Pat. No. 6,071,173 to Kelley, and U.S. Patent No. 2011/0104982 to Koehl. In both instances, a spherical mass, in the form of a ball bearing or marble, is placed within a hollow cavity in the center or a toy car.

Placing a rolling mass in the center of a toy car, rather than rolling the toy car on wheels has both advantages and disadvantages. The advantages are that the mass of the toy car is typically increased, so it will roll longer once pushed. Additionally, the center of gravity of the toy car is made lower so the toy car is very unlikely to flip. The disadvantages are that the chassis of the toy merely hangs about the spherical rolling mass. As such, the toy car has a tendency to bobble and turn side to side as it is internally pushed by the spherical mass. As such, the toy car is just as likely to roll sidewise as it is to roll forward as it bobbles atop the rolling spherical mass.

The unpredictable direction of a toy that rolls on a spherical mass makes the design unsuited for toys like cars and trucks that are expected to travel only in the direction that the toy car or truck is pointed.

The Applicant has improved upon the technology of toys with internal rolling spherical masses and has developed a toy system that takes advantage of the unusual rolling characteristics embodied by a toy with an internal spherical mass. The new toy design is described and claimed below.

SUMMARY OF THE INVENTION

A rolling toy assembly that has a hollow body. The hollow body has an interior and a bottom surface with an open window that accesses the interior. A spherical mass is disposed within the interior of the hollow body. The spherical mass is too large to pass completely through the open window. As such, only a segment of the spherical mass extends out of said hollow body through the open window.

An eccentric weight is coupled to the hollow body. The eccentric weight biases the hollow body into a tilted position wherein the bottom surface and the window are tilted at an angle of inclination. This enables the toy assembly to roll over small obstacles.

A play platform is provided. The play platform has a top surface that defines at least one concavity. The concavity is surrounded by a peripheral rim bump.

The toy assembly is placed on the play platform and is caused to roll by manually manipulating the play platform. The toy assembly rolls over the rim bump as the toy assembly rolls into and out of the concavity. This causes the toy assembly to turn and perform complicated moves that add to the play value of the overall toy.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE DRAWINGS

Although the present invention rolling toy system can be embodied in many ways, only one embodiment is illustrated and described. This embodiment is selected in order to set forth one of the best modes contemplated for the invention. The illustrated embodiment, however, is merely exemplary and should not be considered a limitation when interpreting the scope of the appended claims.

Figure 1:
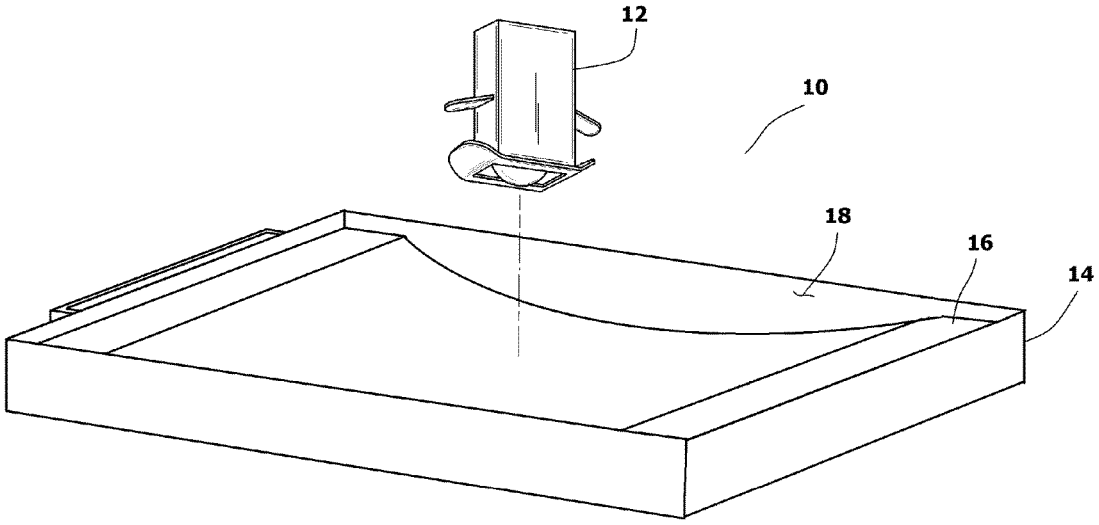
FIG. 1 is a perspective view of an exemplary embodiment of a rolling toy system containing a rolling toy character and a play platform.

Referring to FIG. 1, a rolling toy system 10 is shown that is comprised of a rolling toy character 12 and a play platform 14 having a top surface 16 with at least one concavity 18. The rolling toy character 12 is placed on the top surface 16 of the play platform 14. The play platform 14 is then manually manipulated in the roll, pitch and yaw planes to make the rolling toy character 12 roll around the top surface 16 of the play platform 14 and across any concavities 18 contained on that top surface 16. In the preferred embodiment, the rolling toy character 12 is decorated as a skateboarder and the play platform 14 is decorated as a skateboard pool. However, as will be later explained, other decorative themes can be adopted.

Figure 2:
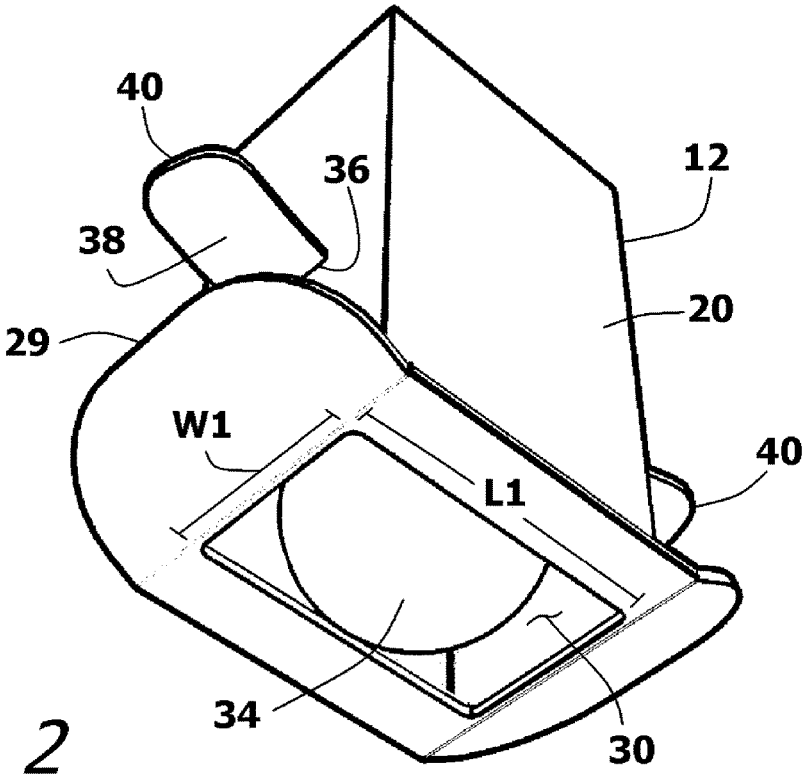
FIG. 2 is a bottom perspective view of the rolling toy character shown in FIG. 1.
Figure 3:
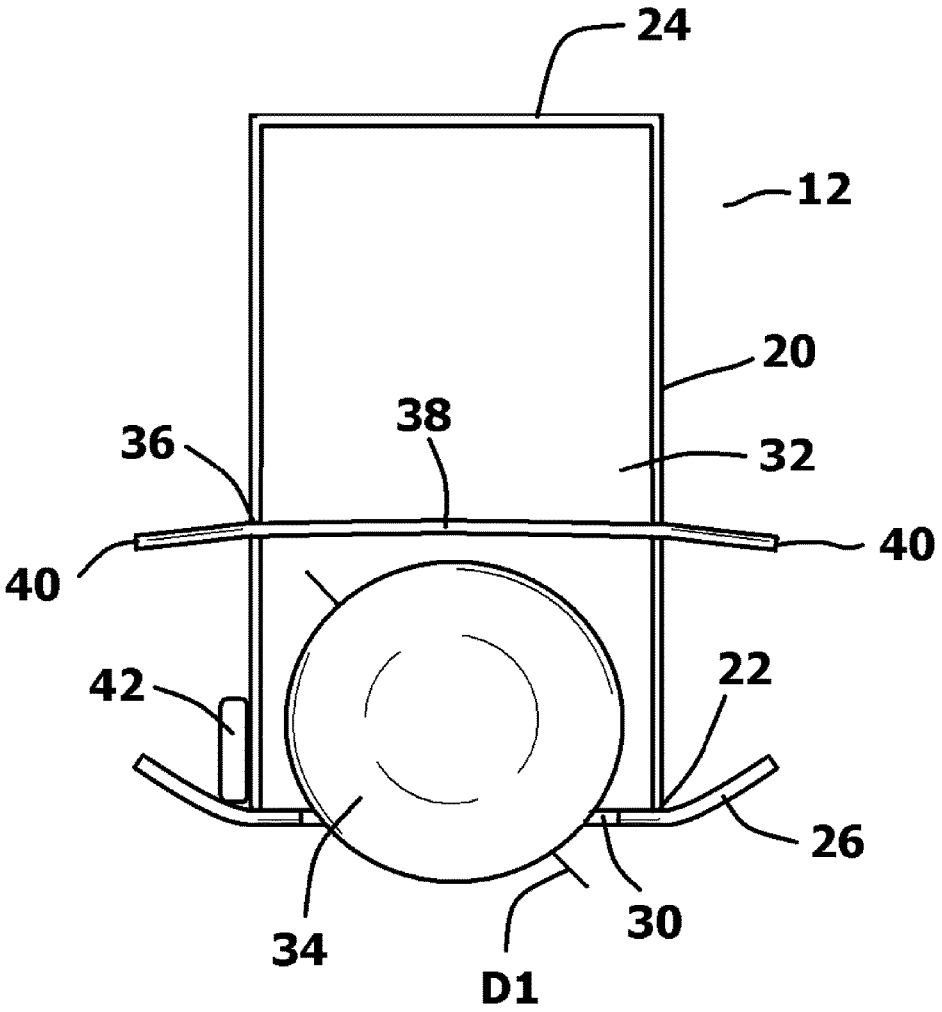
FIG. 3 is a cross-sectional view of the rolling toy character.

Referring to FIG. 2 in conjunction with FIG. 3, it will be understood that the rolling toy character 12 has a hollow body 20. In the shown illustrations, the hollow body 20 has the shape of a rectangular box. Such a shape is exemplary and it should be understood that the hollow body 20 can be cylindrical in shape or have a periphery that follows any polygonal shape. The hollow body 20 is made from lightweight material and preferably made of folded paper. As such, a rectangular shape is shown for the hollow body 20, since this shape is easy to form with folded paper.

The hollow body 20 has an interior 32 that extends from an open bottom 22 to a closed top 24. The open bottom 22 of the hollow body 20 interconnects to a wide base 26. The wide base 26 has a length and width that are both larger than the open bottom 22 of the hollow body 20. The wide base 26 can also be made of paper and can be folded from the same blank of paper as is the hollow body 20.

The wide base 26 has two long edges 28 and two short edges 29. The short edges 29 are curved. The long edges 28 bend upwardly toward the short edges 29 as the long edges 28 approach the short edges 29. The bends are formed naturally in the paper material of the wide base 26. A window 30 is formed through the wide base 26 that intersects the interior 32 of the hollow body 20. The window 30 has a length L1 and a width W1.

A spherical mass 34 is disposed within the interior 32 of the hollow body 20. The spherical mass 34 has a diameter D1 that enables the spherical mass 34 to freely fit within the interior 32 of the hollow body 20. However, the diameter D1 is larger than the width W1 of the window 30. As such, the spherical mass 34 is incapable of completely passing through the window 30. Rather, the spherical mass 34 rests upon the interior of the window 30, wherein only a small segment of the spherical mass 34 is capable of extending out through the window 30.

The spherical mass 34 is preferably a metal ball bearing or a glass marble. As such, the spherical mass 34 is much heavier than the weight of the hollow body 20. Accordingly, when taken as a complete system, the center of gravity for the entire rolling toy character 12 is only slightly offset from the geometrical center of the spherical mass 34. This provides the rolling toy character 12 with a very low center of gravity that makes it very difficult to tip the rolling toy character 12 onto its side. Rather, the rolling toy character 12 is far more stable in its upright position than it would be in any tipped position. If the rolling toy character 12 ever were to tip to one side, the rolling toy character 12 would immediately upright itself as the play platform 14 is manipulated by a user's hands.

The hollow body 20 has a height that is at least large enough to accommodate the spherical mass 34. For aesthetics, the hollow body 20 is made at least twice as tall as is required to accommodate the spherical mass 34. This produces an open area within the interior 32 of the hollow body 20 above the spherical mass 34.

Slots 36 are formed on opposite sides of the hollow body 20. A retention element 38 is advanced through the slots 36 and across the interior 32 of the hollow body 20. The retention element 38 passes over the spherical mass 34 at a near tangent to the spherical mass 34. As such, the retention element 38 acts as a barrier and restricts the spherical mass 34 from moving higher within the hollow body 20. As such, the presence of the retention element 38 ensures that the spherical mass 34 does not rise up out of the window 30 in the wide base 26.

The retention element 38 can be made of folded paper in the same manner as the hollow body 20. Furthermore, the retention element 38 can be made longer than is necessary so that the free ends 40 of the retention element 38 extend outwardly from the hollow body 20. In this manner, the free ends 40 of the retention element 38 adds the appearance of arms to the rolling toy character 12.

An eccentric weight 42 is added to one side of the hollow body 20 just above the wide base 26. The eccentric weight 42 is positioned above one of the bending sections of the wide base 26. As a result, when the rolling toy character 12 is placed on a flat surface, the spherical mass 34 extends through the window 30 on the wide base 26 and touches the underlying surface. The spherical mass 34 is encased by the widow 30. However, the spherical mass 34 is not attached to the hollow body 20 and is free to roll within the hollow body 20. The presence of the eccentric weight 42 at the side of the hollow body 20 causes the hollow body 20 and the wide base 26 to tilt slightly. As such, the wide base 26 under the eccentric weight 42 is biased against the underlying surface while the opposite end of the wide base 26 is tilted upwardly away from the underlying surface by an angle of inclination A. See FIG. 4. The angle of inclination can be varied by varying the mass of the eccentric weight 42 and/or by altering the curvature of the wide base 26 under the eccentric weight 42.

Figure 4:
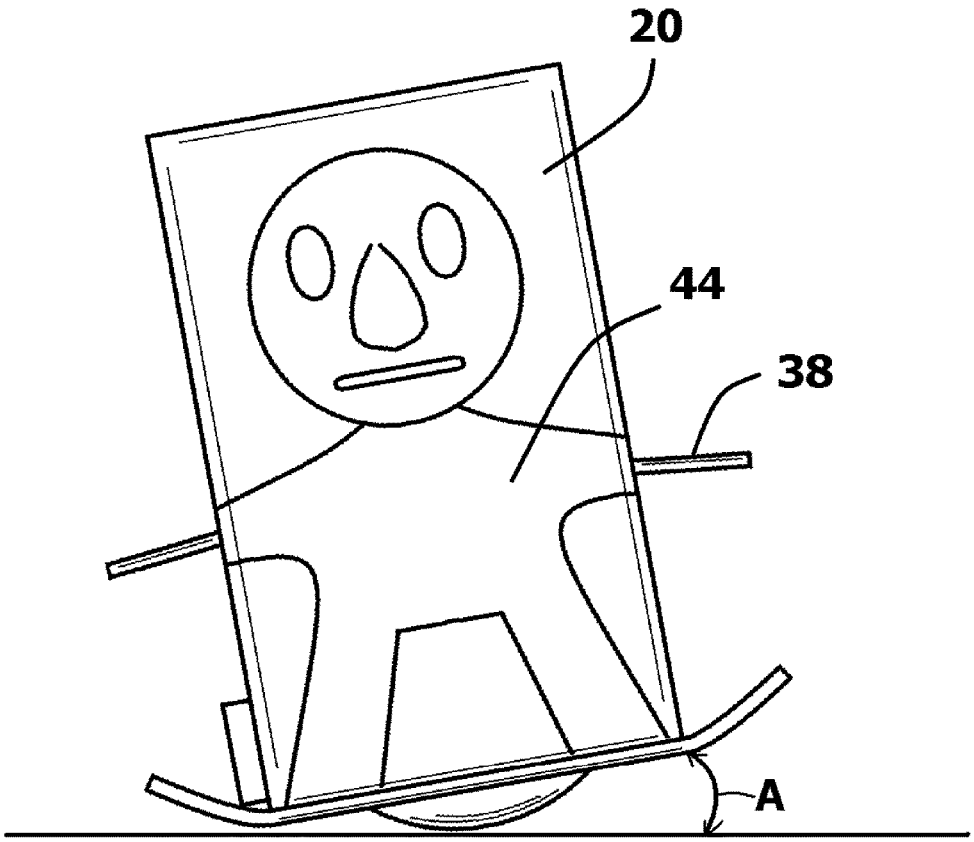
FIG. 4 is a front view of a rolling toy character with graphics.

Referring to FIG. 4, it can be seen that graphics 44 can be printed on the exterior of the hollow body 20. The graphics 44 can depict any object. However, a humanoid character with arms is preferred. Since the hollow body 20 and retention element 38 are preferably made of paper, it is understood that these components can be printed with graphics prior to being folded and assembled into the rolling toy character 12.

Figure 5:
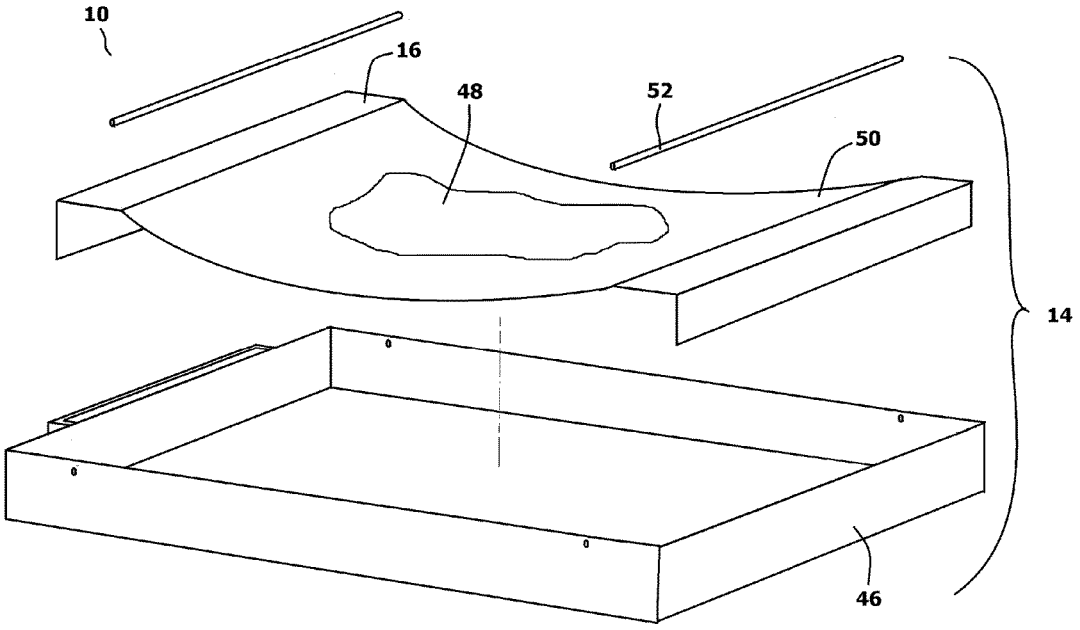
FIG. 5 is an exploded view of the play platform shown in FIG. 1.

Referring to FIG. 5 in conjunction with FIG. 1, it can be seen that the underlying play platform 14 is configured within a box 46. The box 46 can be part of the packaging in which the overall rolling toy system 10 is sold. The play platform 14 includes the contoured top surface 16 upon which the rolling toy character 12 rests. The top surface 16 can be a molded plastic surface. However, in the preferred embodiment, the play platform 14 is made from a folded sheet of heavy paper stock 50. Graphics 48 can be printed in and around the sheet of paper stock 50. In this manner, different sheets of paper stock 50 can be used at different times to alter the graphics 48 presented on the play platform 14.

Figure 6:
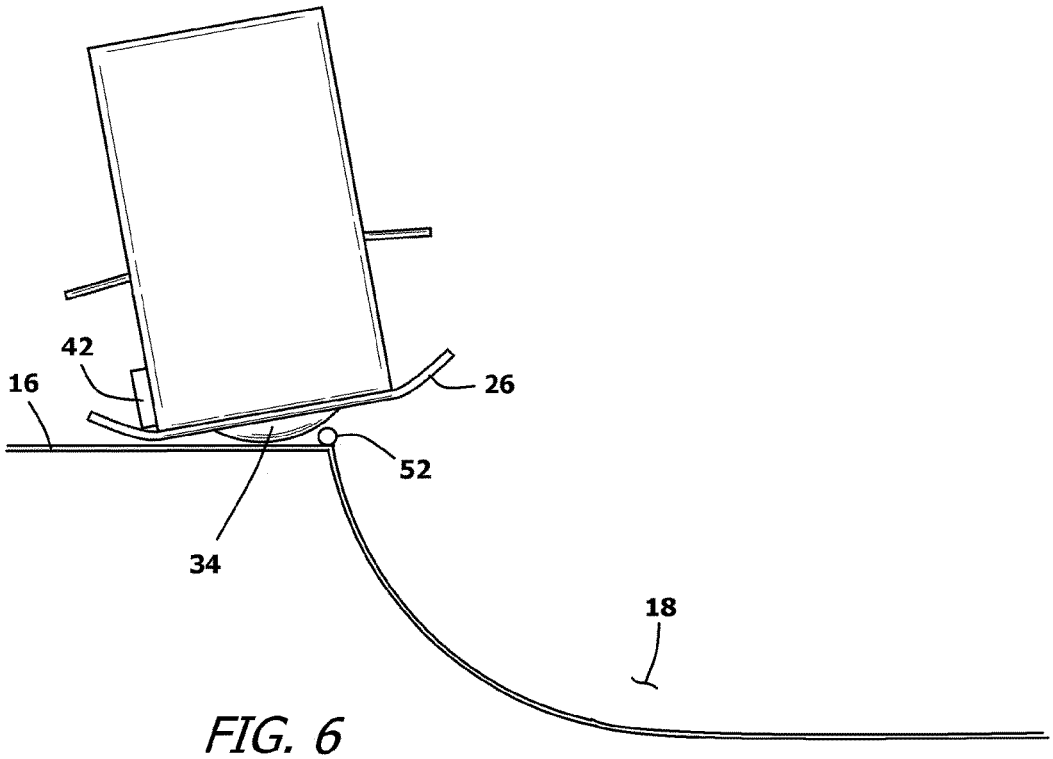
FIG. 6 is a fragmented view showing a segment of the play platform in cross-section with a side view of the rolling toy character.

Referring to FIG. 6 in conjunction with FIG. 1 and FIG. 5, it will be understood that the play platform 14 has a top surface 16 and at least one concavity 18 in the top surface 16. In a preferred embodiment, a rim bump 52 is provided around the periphery of the concavity 18 where the top surface 16 transitions into the concavity 18. The rim bump 52 provides a slight impediment to the rolling of the rolling toy character 12. In this manner, if the rolling toy character 12 is placed onto the play platform 14, it will not accidentally roll into the concavity 18. Rather, the spherical mass 34 abuts against the rim bump 52 and prevents the rolling toy character 12 from rolling into the concavity 18. This enables the rolling toy character 12 to roll around the rim of the concavity 18 without entering the concavity 18. This enables the rolling toy character 12 to appear to perform skateboard tricks around and along the rim of the concavity 18.

If the play platform 14 is tipped to a sufficient angle, the rolling toy character 12 will roll over the rim bump 52 and enter the concavity 18. This dynamic gives the rolling toy character 12 the appearance of jumping into the concavity 18 from the top surface 16 of the play platform 14. The rim bump 52 also has the opposite effect. The rim bump 52 causes the rolling toy character 12 to appear to jump out of the concavity 18 if the rolling toy character 12 is rolled passed the rim bump 52 with enough momentum to roll over the rim bump 52.

Due to the eccentric weight 42, the rolling toy character 12 is tilted. This tilt raises one end of the wide base 26 and enables the wide base 26 of the rolling toy character 12 to clear the rim bump 52. The eccentric weight 42 also causes the rolling toy character 12 to constantly turn and spin while moving in the concavity 18 because the eccentric weight 42 will always bias toward the downhill.

In the shown embodiment, the rim bump 52 is created by two sheppard wires that are used to hold the sheet of paper stock 50 in place. It will be understood that if the play platform 14 were plastic, the rim bump could be a molded feature that surround the periphery of the concavity.

It should also be noted that a phone receptacle 60 can be provided as part of the play platform along at least one side of the play platform 14. The phone receptacle 60 is sized to retain a smart phone so that the camera lens of the smart phone views along the top surface 16 of the play platform 14. In this manner, a video recording can be taken when the rolling toy character 12 moves along the plat platform 14. The play platform 14 is being manipulated to cause movement in the rolling toy character 12. However, since the phone receptacle 60 causes the phone to move with the play platform 14, any video taken by the phone will provide the illusion that the rolling toy character 12 is moving by itself on a stationary play platform 14.

It will be understood that the embodiment of the present invention that is illustrated and described is merely exemplary and that a person skilled in the art can make many variations to that embodiment. For instance, the shape of the toy components can be changed to the design needs of the manufacturer. All such embodiments are intended to be included within the scope of the present invention as defined by the claims.

What is claimed is:

1. A rolling toy assembly, comprising:

a base having an open window formed therethrough, wherein said base has a two opposite long edges of a first length and two opposite short edges of a first width;

a hollow body having opposing sides, an interior, an open bottom, and slots that are formed in said opposing sides of said hollow body, wherein said open bottom of said hollow body interconnects with said base over said open window, therein providing access to said interior of said hollow body through said open window in said hollow base, wherein said first length and said first width of said base are greater than that of said open end of said hollow body causing said two opposite long edges and two opposite short edges of said base to extend beyond said open end of said body so as not to be covered by said open end of said body;

a spherical mass disposed in said interior of said hollow body, wherein said spherical mass is too large to pass completely through said window of said base, wherein only a segment of said spherical mass extends out of said hollow body through said window in said base;

a retention element separate and distinct from said hollow body that extends through said slots and across said interior of said hollow body, wherein said retention element limits movement of said spherical mass within said interior in a direction away from said window; and an eccentric weight that biases said hollow body and said base into a tilted position wherein said window is tilted at an angle of inclination.

2. The assembly according to claim 1, wherein said retention element has a first end and an opposite second end, wherein said first end and said second end extend through said slots to positions outside of said hollow body.

3. The assembly according to claim 2, wherein said retention element is paper.

4. The assembly according to claim 1, wherein said hollow body is fabricated from folded paper.

5. The assembly according to claim 1, wherein said spherical mass is comprised of a material selected from a group that includes metal and glass.

6. A rolling toy assembly, comprising:

a base having an open window formed therethrough;

a hollow body disposed upon said base, said hollow body having opposing sides and an interior that is accessible through said open window;

slots are formed in said opposing sides of said hollow body;

a spherical mass disposed in said interior of said hollow body, wherein said spherical mass is too large to pass completely through said open window, wherein only a segment of said spherical mass extends out of said hollow body through said open window in said base; and a retention element that is separate and distinct from said hollow body that extends through said slots and across said interior of said hollow body between said opposing sides, wherein said retention element limits movement of said spherical mass within said interior in a direction away from said window.

7. The assembly according to claim 6, further including an eccentric weight coupled to said hollow body that biases said base and said hollow body into a tilted position wherein said base and said window are tilted at an angle of inclination.

8. The assembly according to claim 7, wherein said base is wider than said hollow body and has curved sections that curve away from said open window.

9. The assembly according to claim 6, wherein said retention element extends through said slots in said hollow body, therein forming arms that externally extend from said hollow body.

10. The assembly according to claim 6, wherein said hollow body is rectangular in shape.

11. The assembly according to claim 6, wherein said hollow body is fabricated from folded paper.

12. The assembly according to claim 6, wherein said folded paper has graphics printed thereon that present a character when folded into said hollow body.

* * * * *